United States Patent [19]

Holder

[11] Patent Number: 4,531,076

[45] Date of Patent: Jul. 23, 1985

[54] ELECTRON BEAM STIMULATED ELECTROMAGNETIC RADIATION GENERATOR

[75] Inventor: James D. Holder, Huntsville, Ala.

[73] Assignee: The United States of America as represented by the Secretary of the Army, Washington, D.C.

[21] Appl. No.: 446,091

[22] Filed: Dec. 2, 1982

[51] Int. Cl.[3] ..... H01J 25/00

[52] U.S. Cl. ..... 315/4; 372/2; 315/5; 315/5.24; 315/5.35

[58] Field of Search ..... 315/3, 4, 5, 5.24, 5.35; 372/2

[56] References Cited

U.S. PATENT DOCUMENTS

| | | | |
|---|---|---|---|
| 2,879,439 | 3/1959 | Townes | 315/5.35 X |
| 3,259,786 | 7/1966 | Phillips | 315/3 |
| 3,398,376 | 8/1968 | Hirshfield | 315/5.24 X |
| 3,921,027 | 11/1975 | Shelton et al. | 315/5.39 |
| 4,189,660 | 2/1980 | Dandl | 315/4 |
| 4,189,686 | 2/1980 | Brau et al. | 372/2 |
| 4,287,488 | 9/1981 | Brau et al. | 372/2 |
| 4,298,824 | 11/1981 | Walsh | 315/4 |
| 4,393,332 | 7/1983 | Symons | 315/4 |
| 4,395,655 | 7/1983 | Wurthman | 315/5.35 |

OTHER PUBLICATIONS

"Experimental Study of Radiation at Submillimeter Wavelengths", by Granatstein et al., 1974, MTT-22, No. 12, IEEE Transactions on Microwave Theory and Techniques.

"Coherent Radiation from a Modulated Rectilinear Electron Beam", by Abramov et al., Sov. Phys. Tech., vol. 21, No. 1, 1/76.

"A Submillimeter Free-Electron Laser Exp.", by Birkett et al., IEEE Journal of Quantum Electronic, vol. QE-17, No. 8, 8/81.

"High Power Klystron Amplifiers", Tube Department, General Electric Company, undated, pp. 3-14.

Howgate et al., "New Laser Concepts-Executive Summary Report", U.S. Army Missile Research and Development Command, Redstone Arsenal, AL, Technical Report H-78-2, Nov. 1977, pp. 25-45.

Howgate et al., "New Laser Concepts Evaluation: Review", U.S. Army Missile Research and Development Command, Redstone Arsenal, AL, Technical Report DRCPM-HEL-79-4, Feb. 1979, pp. 15-25.

*Primary Examiner*—Saxfield Chatmon

*Attorney, Agent, or Firm*—Anthony T. Lane; Robert P. Gibson; Freddie M. Bush

[57] ABSTRACT

Radio frequency or microwave electromagnetic radiation is generated within and radiated from a cavity in response to an electron beam directed through the cavity. The electron beam is initially directed axially into the cavity and is deflected away from the axis by a time-varying field. The field may be magnetic or electrostatic and results in the radiation waves being generated as the beam deflects first to one side and then the other. Energy is reflected within the cavity, building up to provide an output pulse. The particular frequency generated is a function of the electron beam velocity and the time varying field or frequency at which the field varies.

5 Claims, 2 Drawing Figures

ELECTRON BEAM STIMULATED ELECTROMAGNETIC RADIATION GENERATOR

The invention described herein may be manufactured, used, and licensed by or for the Government for governmental purposes without payment to me of any royalties thereon.

BACKGROUND OF THE INVENTION

A beam of electrons may be made to operate similar to a laser generator and generate laser radiation of selectable frequency with very high efficiency. This is done by directing the beam of electrons along a path or axis around which is selectively placed several sets of magnets, adjacent magnets having opposing polarity. The opposing polarity forces an electron beam passing therethrough to accelerate and move or wiggle from side to side along its path. Light radiation is generated by these accelerations and is radiated toward and reflected from mirrors located at each end of the beam path. The light radiation reflects back and forth in a self synchronizing manner. When a sufficient level of this energy is present in the beam chamber, a burst of synchronized output laser energy occurs. The waves have been generated at infrared frequencies. The particular frequency of emitted energy is related to the magnet-set spacing and to the beam energy and is limited to these small laser wavelengths since the magnet-set spacing becomes larger as the wavelength increases, becoming prohibitive for lower frequencies such as radio frequencies.

SUMMARY OF THE INVENTION

The apparatus of the instant invention relates to a means of generating electromagnetic radiation and in particular to generating radio frequency and microwave radiation. An electron beam is directed along an axial path through a cavity or chamber. The electron beam is controllably deflected back and forth across the axis by a time-varying magnetic or electrostatic field resulting in radio frequency waves being generated as the beam is accelerated first to one side and then the other. Energy is reflected within the cavity, building up until an output burst of coherent energy is emitted at one end of the cavity.

DESCRIPTION OF THE PREFERRED EMBODIMENT

Required parameters for making an electron beam laser are that the electron beam be accelerated from side to side to generate electromagnetic energy waves as the beam moves through a cavity, and that there be suitable reflectors placed at each end of the cavity to permit buildup of the energy. To accomplish acceleration from side to side, several sets of magnets have been arranged along this electron beam axis or path with alternate magnets having opposing polarity. This spatially fixed and constant set of magnets in conjunction with the energy of the electron beam determine the particular laser frequency emitted. This method of generating frequencies is prohibitive at lower frequencies since the magnet-set spacing becomes very large at lower frequencies, increasing the cavity length.

Figure 1:
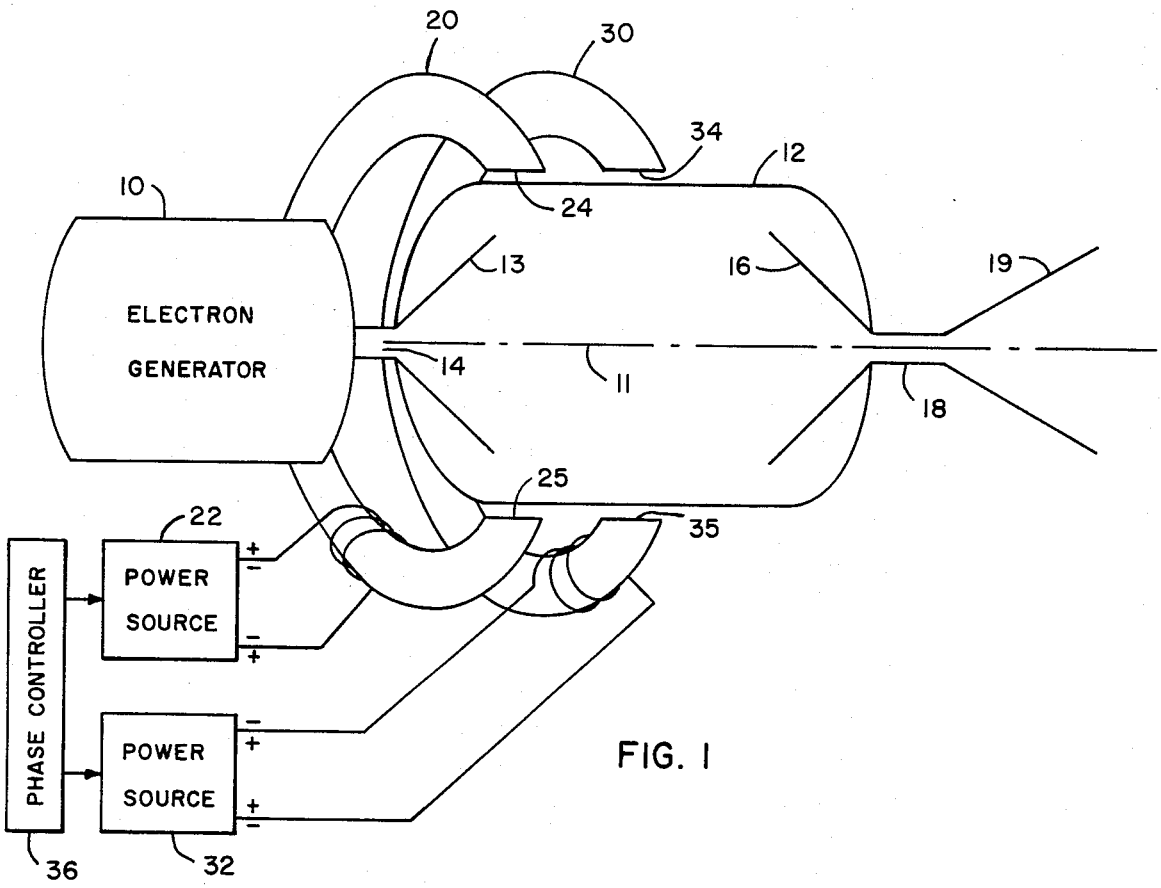
FIG. 1 is a diagrammatic view of apparatus for providing electromagnetic radiation from an electron beam source.

Microwave and radio frequency electromagnetic waves can be generated, however, using the electron beam energy passing through a time varying field of magnetic or electrostatic origin. Just as with the laser generator, the particular frequency of emitted energy is related to or a function of the magnet spacing and the electron beam energy. Increasing or decreasing the beam energy for a given spacing between magnets, causes a corresponding decrease or increase in frequency. Similarly, spacing the magnets closer together for a given beam energy results in a smaller wavelength. In addition to these parameters, the phase and polarity relationship of the time-varying magnetic or electric fields introduces a third controllable parameter which effects the wavelength generated. Thus, by adjusting any one or combination of these three parameters, and by using only one magnet-pair, radio frequencies may be generated without the physical size being prohibitive. A system which provides these lower frequency electromagnetic waves is shown in the preferred embodiment of FIG. 1.

An electron beam source 10 produces a well formed electron beam directed along axis 11 into an evacuated chamber cavity 12. A radio frequency or microwave corner cube retroreflecter 13 at the input end of the cavity has a window 14 therein to permit entry of the electron beam. A similar retroreflector 16 at the output end of the cavity is fitted to a waveguide 18 or other suitable transmission line for the frequency to be generated. Waveguide 18 may then be coupled to an antenna 19 for radiation of the generated electromagnetic wave or to another desirable load device. Side to side acceleration is accomplished with only a pair of wiggler magnets 20 and 30 which are driven respectively by adjustable power sources 22 and 32. Power sources 22 and 32 are excitation sources of alternating current. By using a phase controller 36 to either vary or maintain the phase relationship between the power sources the relative strength of the fields between the two magnets can be used to control the generated frequency and efficiency of the operation. Typically wiggler magnet 20 has end surfaces 24 and 25 diametrically opposed across cavity 12 for developing a magnetic field therebetween and passing through axis 11. Similarly, magnet 30 has end surfaces 34 and 35 arranged adjacent to magnet 20 for developing a magnetic field parallel to and in phase relationship and polarity, as determined by controller 36, to the field developed by magnet 20 through axis 11. Thus, where power sources 22 and 32 have identical windings coupled around the respective magnets the current through the windings will be in opposition to provide maximum opposing fields if a 180° difference in phase exists. For this special case the power supplies are synchronized to assure substantially simultaneous field reversal as the ac voltage varies, thereby providing one complete spatial period for frequency generation.

In operation, an electron beam from source 10 is established in the cavity, being collected by retroreflector 16 or other collection means (not shown) adjacent thereto for dumping the electron beam without interferring with the electromagnetic waves generated in the cavity. The current from sources 22 and 32 drives wiggler magnets 20 and 30, producing respective magnetic fluxes of opposing or alternating polarity which deflects and accelerates the electron beam first to one side and then to the other side of axis 11 as the electron beam passes through the fields between surfaces 24 and 25 and surfaces 34 and 35. The resultant electromagnetic waves generated by the acceleration action are reflected back and forth between the retroreflectors 13 and 16 until the desired level of energy is achieved. At this time, the coherent radio frequency pulse or microwave pulse is generated and is propagated through waveguide 18 to antenna 19 for radiation into free space. The wiggler magnets 20 and 30, although shown as iron core devices for clarity of magnetic pole location, may be air or vacuum core inductors. This permits a much higher flux development across the magnetic gap and permits very high radio frequencies to be developed.

Figure 2:
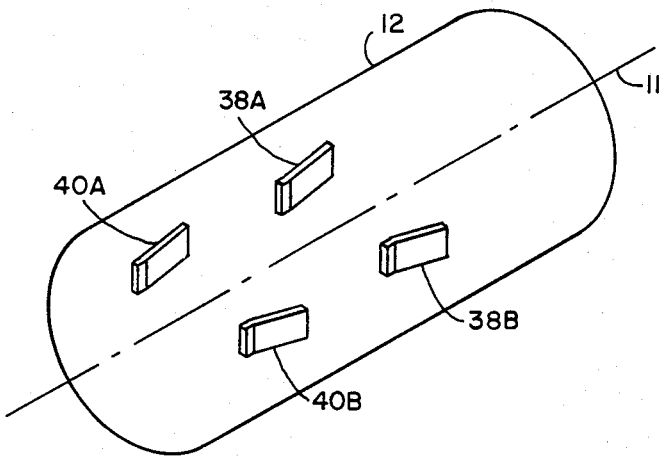
FIG. 2 is a perspective view of the cavity of FIG. 1 adapted for an electrostatic field.

Deflection of the electron beam can also be accomplished by using electrostatic fields as is done by the horizontal and vertical deflection plates of a cathode ray tube. As shown typically in FIG. 2, a segment of cavity 12 is shown using electrostatic deflection instead of magnetic deflection. With deflection plates 38A and 38B and deflection plates 40A and 40B the beam can be sequentially accelerated back and forth across axis 11 so that the beam stays relatively close to the axis while generating very high coherent radio frequency output waves. A power source (not shown) provides alternate polarity signals to the plates in sequence to deflect the beam.

Although a particular embodiment and form of this invention has been illustrated, it is apparent that various modifications and embodiments of the invention may be made by those skilled in the art without departing from the scope and spirit of the foregoing disclosure. For example an ionization switch may be used to prevent partial loss of the radio frequency pulse into the electron beam source and electron beam focusing may be used to control the beam density and reduce electron scattering. Accordingly the scope of the invention should be limited only by the claims appended hereto.

I claim:

1. An electromagnetic radiation generator comprising: an evacuated chamber; an electron source for directing a beam of electrons axially into said chamber; deflection means positioned adjacent said chamber for time varying deflection of said electron beam by varying said deflection of the beam as it passes through respective first and second parallel planes normal to axial flow through said chamber and thereby generating electromagnetic radiation within said chamber; means for coupling said electromagnetic radiation from the chamber; and said deflection means is a pair of wiggler magnets each having first and second poles disposed in parallel planes across said chamber and said magnets having an adjustable frequency power source for controllably varying respective rates of magnetic field alternation across said chamber in adjustable phase relationship within said first and second planes normal to the beam axis.

2. An electromagnetic radiation generator as set forth in claim 1 wherein said deflection means is magnetic.

3. An electromagnetic radiation generator as set forth in claim 3 wherein said electromagnetic radiation is a radio frequency.

4. An electromagnetic radiation generator as set forth in claim 4 and further comprising corner cube retroreflectors disposed within said chamber for providing a cavity and reflecting said electromagnetic radiation therebetween.

5. An electromagnetic radiation generator comprising: an evacuated chamber; an electron source for directing a beam of electrons axially into said chamber; deflection means positioned adjacent said chamber for time varying deflection of said electron beam by varying said deflection of the beam as it passes through respective first and second parallel planes normal to axial flow through said chamber and thereby generating electromagnetic radiation within said chamber; means for coupling said electromagnetic radiation from the chamber; said deflection means being electrostatic and being disposed for controllably alternating the polarity of electrostatic fields across said chamber, normal to said beam axis, in said first and second planes; and corner cube retroreflectors disposed within said chamber for providing a cavity for reflecting said electromagnetic radiation therebetween.

* * * * *